US007011022B2

(12) United States Patent
Motard et al.

(10) Patent No.: US 7,011,022 B2
(45) Date of Patent: Mar. 14, 2006

(54) OFFSET PRINTING PRESS UNIT WITH REMOVABLE CYLINDERS

(75) Inventors: Marcel Motard, Laval (CA); Eric Short, Kirkland (CA)

(73) Assignee: RDP Marathon Inc., Laval (CA)

( * ) Notice: Subject to any disclaimer, the term of this patent is extended or adjusted under 35 U.S.C. 154(b) by 51 days.

(21) Appl. No.: 10/765,083

(22) Filed: Jan. 28, 2004

(65) Prior Publication Data

US 2005/0160928 A1 Jul. 28, 2005

(51) Int. Cl.
*B41F 13/20* (2006.01)
*B41F 13/44* (2006.01)

(52) U.S. Cl. ..... 101/217; 101/479; 101/247

(58) Field of Classification Search ..... 101/174, 101/177, 182, 185, 216, 217, 218, 247, 375, 101/376, 479

See application file for complete search history.

(56) References Cited

U.S. PATENT DOCUMENTS

| | | | | |
|---|---|---|---|---|
| 1,934,776 | A | 11/1933 | Stoessel | |
| 3,108,536 | A | 10/1963 | Harrison | |
| 3,147,702 | A | 9/1964 | Mrtin | |
| 3,616,751 | A | 11/1971 | Mowry | |
| 5,787,808 | A | 8/1998 | Stram et al. | |
| 6,520,083 | B1 * | 2/2003 | Petersen et al. | 101/401.1 |
| 6,655,279 | B1 * | 12/2003 | Tsukamoto | 101/350.1 |
| 2005/0188866 | A1 * | 9/2005 | Ruoff et al. | 101/217 |

FOREIGN PATENT DOCUMENTS

| | | |
|---|---|---|
| DE | 296 01 151 | 4/1996 |
| DE | 199 55 084 | 5/2001 |

* cited by examiner

*Primary Examiner*—Leslie J. Evanisko
(74) *Attorney, Agent, or Firm*—Ogilvy Renault LLP

(57) ABSTRACT

An offset printing press having plate and blanket cylinder retention mechanisms, each retention mechanism having at least one trunnion axially displaceable between an operative position and a disengaged position. Said trunnion is freely disconnected from an associated cylinder end in the disengaged position such that the plate cylinder and the blanket cylinder are removable from the printing press from between the frame structure. One of the cylinder retention mechanisms is selectively displaceable relative to the frame structure such that a distance between the cylinder axes of rotation is variable. The plate and blanket cylinders are thus removable from the printing press and substitutable with replacement cylinders having a different outer circumference. The press comprises a gear drive system which remains in gear meshed engagement with both the plate cylinder and the blanket cylinder regardless of the variable relative positions thereof.

13 Claims, 5 Drawing Sheets

OFFSET PRINTING PRESS UNIT WITH REMOVABLE CYLINDERS

TECHNICAL FIELD

The present invention relates generally to offset printing presses, and more particularly to an offset printing press unit having removable plate and blanket cylinders.

BACKGROUND OF THE INVENTION

Offset printing presses are well known in the art. Typically, water and ink are supplied to a printing plate cylinder, and are then transferred to a blanket cylinder for printing onto sheets or web, fed between the blanket cylinder and an impression cylinder. The water supply to the plate cylinder usually comprises a dampening unit having a dampening form roller which contacts the plate cylinder and is fed water from a water pan through intermediate water transferring rollers. Similarly, an inking unit transfers ink from an ink supply to the plate cylinder through an ink transfer and application rollers.

While such presses have fixed lateral dimensions, and as such printed products wider than the length of the cylinders cannot be produced, the circumference of the rotating cylinders determines the length of each repeated pattern being printed onto the web or sheets passing therethrough. Accordingly, the larger the circumference of the plate and blanket cylinders being used, the longer the printed pattern that can be produced. Therefore, in order to permit a press to be modified to permit printing of difference sized "repeats", or each repeated pattern that is printed onto the web for each revolution of the cylinders, it is desirable to be able to use plate and blanket cylinders of different circumferences in order to be able to vary the repeat size provided by the press.

To achieve this desired press convertibility, it has been know to provide an offset press with a removable cylinder cartridge, having at least the plate and blanket cylinders mounted therein. For such a cartridge to be removed from the rest of the printing press, the cylinders must be disengaged from one another, and the entire cartridge is slid out as a single unit from the frame of the press. A replacement cartridge having therein plate and blanket cylinders of a smaller or larger circumference, is then inserted into the press in place of the original cartridge. This therefore permits the press to be converted to change the size of the repeat produced with each rotation of the press cylinders. While this solution provides the press with repeat size flexibility, each cartridge is large and costly, and therefore the practical range of flexibility is generally limited by the cost and space considerations of keeping many different cartridges having cylinders of various sizes.

Various printing presses having removable cylinders are also known. However, to permit the removal of the cylinders requires them to be disengageable from one another. The precisely set contact stripe between the cylinders is therefore often lost. Further, this typically also requires that the intermeshed gears driving the cylinders can be completely disengaged from each other every time a cylinder is to be removed, and easily re-engaged once a new replacement cylinder is introduced into the press. A known way to avoid this problem is to completely replace the gear train by drive motors used to drive the cylinders at the necessary speeds. Particularly, some presses employ a drive motor for each cylinder, thereby circumventing the requirement of gear trains completely. However, printing presses which are completely driven by servo drive systems are more expensive and more complex than those which use traditional gear train drives. Further, if any of the drive motors are incorrectly set or malfunction, the resultant mismatch in cylinder speeds can cause defective printed product or damage to the press.

SUMMARY OF THE INVENTION

It is an object of the present invention to provide an offset printing press with independently removable plate and blanket cylinders.

It is also an object of the present invention to provide an offset printing press having plate and blanket cylinders with replaceable outer sleeves.

It is an object of the present invention to provide an offset printing press having a cylinder drive linkage mechanism which maintains gear mesh when cylinders are disengaged from one another.

It is another object of the present invention to provide a variable form roller throw-off and strip adjustment mechanism for an offset printing press.

Therefore in accordance with the present invention, there is provided an offset printing press comprising: a plate cylinder, a blanket cylinder and an impression cylinder each mounted in a frame structure for rotation about parallel individual axes of rotation, the plate cylinder and the blanket cylinder having a common outer circumference defining a print repeat size produced by the plate and blanket cylinders; plate and blanket cylinder retention mechanisms respectively engaging the plate cylinder and the blanket cylinder, each retention mechanism comprising first and second trunnions rotatable within the frame structure and respectively engageable to a corresponding cylinder end, at least one of said first and second trunnions being axially displaceable by an actuating member between an operative position and a disengaged position, said at least one trunnion being fastenable in mating engagement with said corresponding cylinder end in the operative position and freely disconnected from said corresponding cylinder end in the disengaged position, such that the plate cylinder and the blanket cylinder are removable from the printing press from between the frame structure; and wherein at least one of the plate and blanket cylinder retention mechanisms is selectively displaceable relative to the frame structure such that a distance between the axes of rotation is variable, said at least one cylinder retention mechanism being fastenable in a desired position to maintain the distance at a predetermined value; whereby the plate and blanket cylinders are removable from the printing press and substitutable with replacement cylinders having a different outer circumference, thereby providing a correspondingly different sized print repeat when the replacement cylinders are installed into the printing press.

There is also provided, in accordance with the present invention, a cylinder drive system for an offset printing press having a plate cylinder and a blanket cylinder mounted in a frame structure such that a distance between axes of rotation thereof is selectively variable, the cylinder drive system comprising: a drive motor operatively connected to one of the plate cylinder and the blanket cylinder to provide driven rotation thereto; a gear drive linkage mechanism operably inter-engaging the plate cylinder and the blanket cylinder such that the drive motor drives both the plate and blanket cylinders; and wherein the gear drive linkage mechanism remains in gear meshed engagement with both the plate cylinder and the blanket cylinder regardless of the variable relative positions thereof.

There may also be provided, in accordance with the present invention, an offset printing press including a plate cylinder, a blanket cylinder and an impression cylinder mounted in a frame structure in serial contactable engagement, the printing press comprising a cylinder adjustment mechanism operable to displace at least one of the plate cylinder and the impression cylinder between a predetermined printing position, wherein said at least one of the plate cylinder and the impression cylinder is in contacting engagement with the blanket cylinder, and a disengaged position, wherein said at least one of the plate cylinder and the impression cylinder is removed from contacting engagement with the blanket cylinder, the cylinder adjustment mechanism being selectively actuable and providing controlled variable displacement of said at least one of the plate cylinder and the impression cylinder relative to the blanket cylinder.

BRIEF DESCRIPTION OF THE DRAWINGS

Further features and advantages of the present invention will become apparent from the following detailed description, taken in combination with the appended drawings, in which.

DETAILED DESCRIPTION OF THE PREFERRED EMBODIMENT

Figure 1:
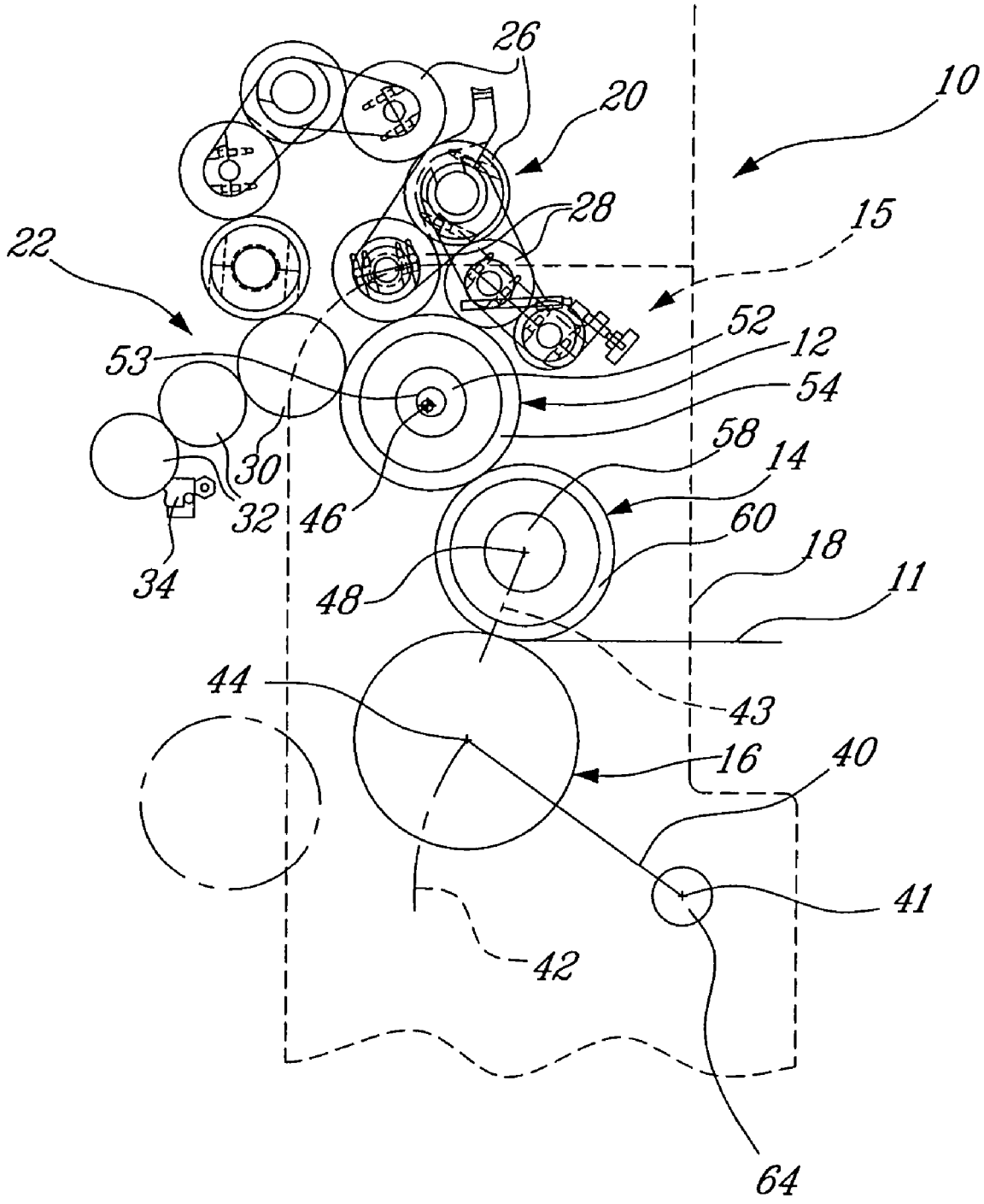
FIG. 1 shows a schematic side elevation view of an offset printing press according to the present invention.
Figure 5B:
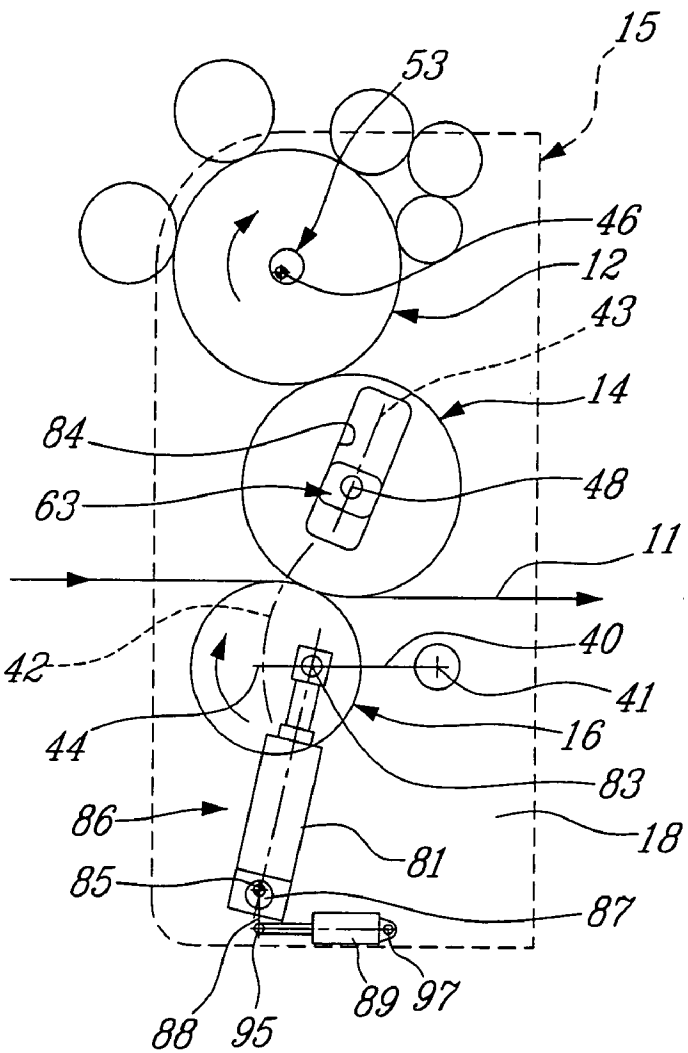
FIG. 5*b* is a schematic side elevation of the offset printing press of FIG. 1, having plate and blanket cylinders of a second, larger diameter.
Figure 5A:
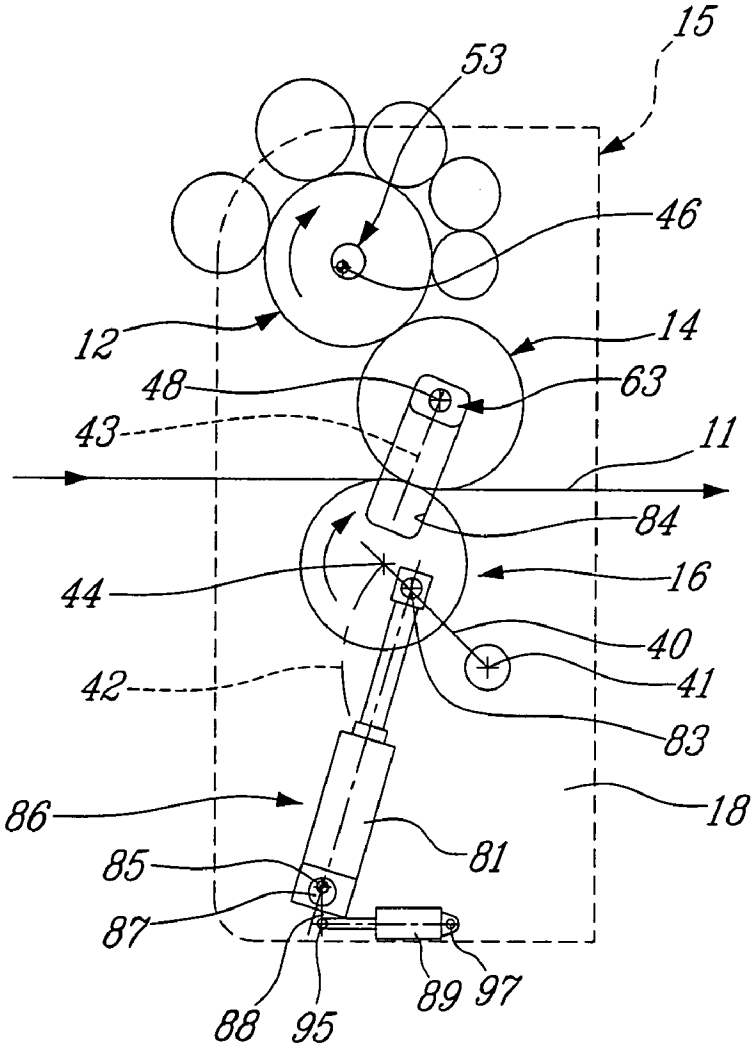
FIG. 5*a* is a schematic side elevation of the offset printing press of FIG. 1, having plate and blanket cylinders of a first diameter.

Referring to FIG. 1 and FIGS. 5*a* and 5*b*, the offset printing press 10 generally comprises a cartridge or unit 15, which can be selectively removed from the main portion of the printing press 10. The printing unit 15 comprises a plate cylinder 12, blanket cylinder 14 and an impression cylinder 16 all supported within a common frame structure 18. Water and ink are supplied to the plate cylinder 12 by the dampening unit 22 and the inking unit 20 respectively. The inking unit 20 generally comprises ink transmission rollers 26 and ink application rollers 28. The inking unit 20 receives ink from an ink supply and transmits it to the plate cylinder 12. The multi roller dampening unit 22 generally comprises a dampening form roller 30 in direct contacting engagement with the plate cylinder 12 and with dampening fluid transfer rollers 32, which transfer the dampening fluid from the dampening supply 34 to the dampening form roller 30. The plate cylinder 12 generally comprises a circumferentially disposed printing plate on the outer surface thereof, the circumference of the plate cylinder corresponding to the length of the print repeat produced by the printing plate. The water and ink fed to the plate cylinder 12 are transferred from the exterior surface thereof to the blanket cylinder 14, which is in contacting engagement with the plate cylinder 12. Either sheets or a continuous web are fed between the blanket cylinder 14 and an impression cylinder 16, which is similarly in contacting engagement with the blanket cylinder 14. All cylinder rollers are rotatable and in precise contacting engagement with each adjacent roller along a contact stripe, such that fluid is transferred from one roller to the next. The term contact stripe is used herein to define the line of contact between two cylindrical rollers in contacting engagement. This contact stripe is precisely set, to ensure exact and uniform contact pressure the entire length of the rollers.

As mentioned above, the circumference of the rotating cylinders determines the length of each repeated pattern being printed onto the web passing therethrough. The term repeat is generally used herein to define this repeated pattern that is printed on the web for every revolution of the plate and blanket cylinders. In order to allow for a wide range of print repeat sizes at a relatively low cost, the offset printing press 10 of the present invention permits the plate and blanket cylinders 12 and 14 respectively to be independently removed from the printing unit 15 such that they can be replaced with corresponding cylinders having a different circumference. This accordingly permits the size of the repeat to be easily changed. Rather than having to store a large number of pairs of plate and blanket cylinders 12,14 having different circumferences, the interchangeable plate and blanket cylinders 12,14 of the present invention preferably have common central mandrel shafts to which outer sleeves of various circumferences can be selectively engaged.

Particularly, referring to FIG. 1, the plate cylinder 12 comprises a central mandrel shaft 52, which has a central axis 46, and an outer plate sleeve 54 mounted thereto. The outer plate sleeve 54, as with all interchangeable sleeves disclosed herein, is mounted to the central mandrel such that the sleeve is removably engaged thereto and is rotatable therewith. The sleeve may be press fit onto the mandrel, or otherwise fixed in place thereon. To remove such a press fit sleeve, air pressure is preferably used to create an air layer between the sleeve and the mandrel shaft, thereby permitting the sleeve to freely slide off the mandrel shaft. The central mandrel shaft 52 of the plate cylinder 12 is held in the press by a plate cylinder retention mechanism, which comprises at least one axially displaceable plate cylinder trunnion 47*a* (seen in FIGS. 2 and 4). An axially fixed plate cylinder trunnion 47*b* supports the opposite end of the cylinder, and is rotatable within the press frame. The plate cylinder trunnions 47*a,b* engage the mandrel shaft 52 in a predetermined center position and are free to rotate in their frame mountings. The trunnions 47*a,b* are positioned in place in the frame structure 18 by bearings within which they are free to rotate. The trunnions 47*a,b* engage the ends of the mandrel shaft 52 such that substantially no relative rotation therebetween occurs when they are in mated engagement. Axial outward displacement of at least the trunnions 47*a* permits the removal of the plate cylinder 12 from the press, and will be described in further detail below. While preferably only the one plate cylinder trunnion 47*a* is axially displaceable, it is understood that both plate cylinder trunnions 47*a* and 47*b* may be axially displaceable.

The blanket cylinder 14 comprises a central mandrel shaft 58 having a central axis 48. In the embodiment of FIG. 1, an outer sleeve 60, having the same first outer circumference as the plate sleeve 54, is similarly mounted to the central mandrel shaft 58 of the blanket cylinder 14. The blanket cylinder's displacement line 43 depicts the possible locations for the blanket cylinder central axis 48 within the frame. The blanket cylinder 14 is also preferably removably engaged within the press by a blanket cylinder retention mechanism, which comprises at least one axially displaceable blanket cylinder trunnion 49*a* (seen in FIGS. 2 and 4) that engages and supports one end of the central mandrel shaft 58 of the blanket cylinder 14. An axially fixed blanket cylinder trunnion 49*b* supports the opposite end of the cylinder, and is rotatable within the press frame. The blanket cylinder trunnions 49*a* and 49*b* extend through the frame structure 18 of the printing unit 15, being supported and located therein by translating bearing-blocks 63 (as seen FIGS. 5*a* and 5*b*) which can slide within corresponding guide slots 84 defined in the frame structure 18, such that the central axis 48 of the blanket cylinder 14 can be located anywhere along the blanket cylinder central axis displacement line 43. The translating bearing-blocks 63 can be fixed in any desired position within the guide slots 84. While preferably only the one blanket cylinder trunnion 49*a* is axially displaceable, it is understood that both blanket cylinder trunnions 49*a* and 49*b* may be axially displaceable.

Actuating members are preferably used to displace at least the trunnions 47*a* and 49*a* between inner the operative position, wherein the trunnions are forced into mating engagement with the ends of each cylinder such that the trunnions and the cylinders rotate together, and the disengaged position, where the trunnions are freely disconnected from the ends of the cylinders such that removal of the cylinders is possible. The actuating members can be any suitable mechanism for axially displacing the trunnions inward and outward relative to the cylinders, such as for example a pneumatically operated cylinder. Preferably, the actuating members are remotely operated, such that the trunnions can be engaged and disengaged from the cylinders by a press operator from a control station. However, a manual override for such a pneumatically operated actuating member can also provided.

Thus, both the plate cylinder 12 and blanket cylinder 14 can be independently removed from the press. Once removed, the outer sleeves 54 and 60 can be disengaged from the central mandrel shafts 52 and 58 of the plate cylinder 12 and the blanket cylinder 14 respectively. This therefore permits the outer sleeves to be replaced by alternately sized sleeves, such that the overall outer circumference of the cylinders can be varied. Preferably, only the outer sleeves on the common central mandrel shafts need be replaced in order to change the size of the repeat produced. However, it is also possible to use solid or one-piece cylinders without sleeves, in which case the entire cylinder is replaced. Although, this may be more expensive and necessitate greater storage requirements, one-piece cylinders are nonetheless useful for certain printing applications.

Figure 2:
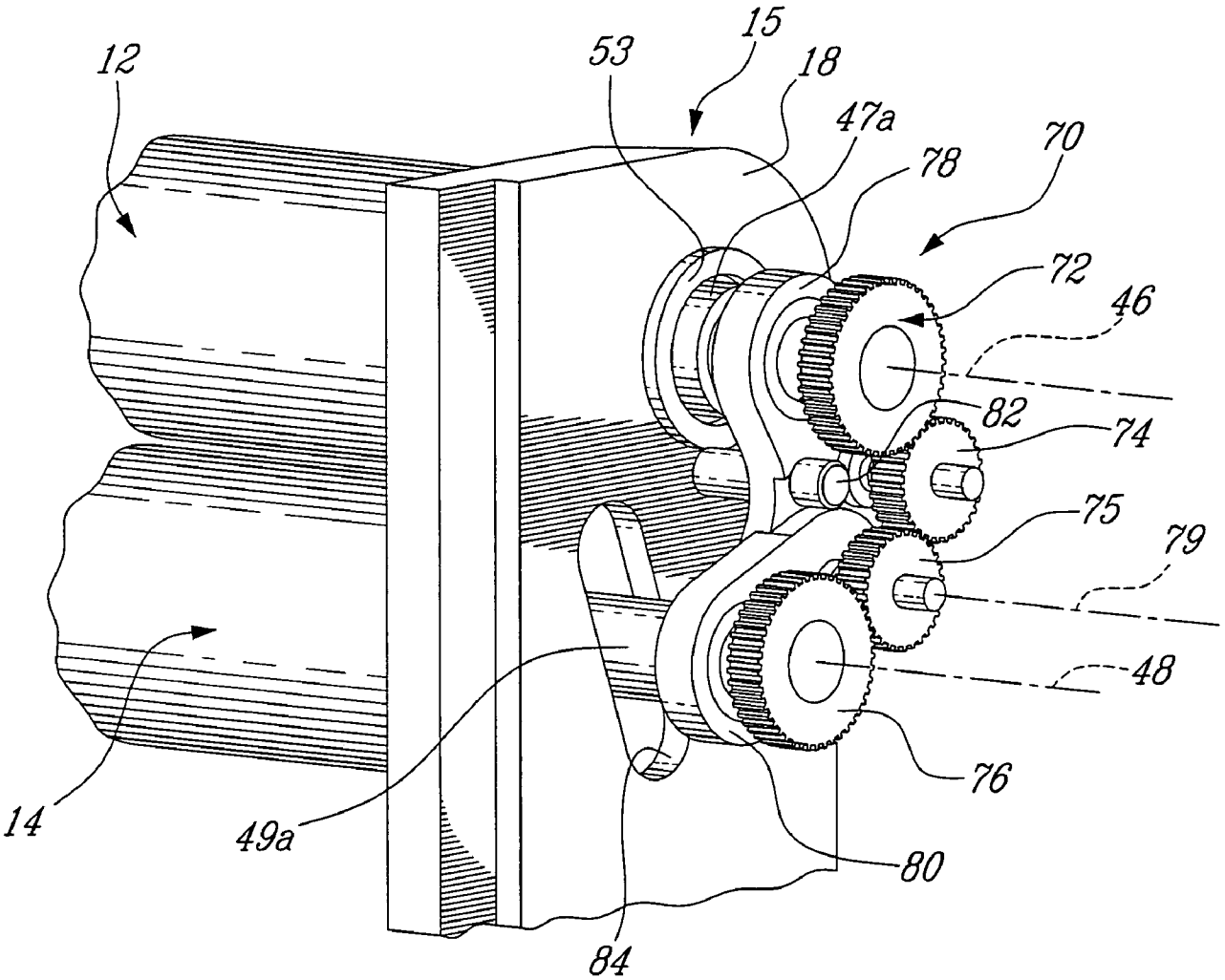
FIG. 2 is a schematic perspective view of a drive linkage mechanism according to the present invention, for use on the printing press of FIG. 1.

The bearing mounting assembly 53 of the plate cylinder 12 are preferably not translatable within the frame structure 18, regardless of the size of the plate cylinder 12, however the mounting assemblies 53 are rotatable therewithin. Referring to FIG. 2, each end of the plate cylinder 12 (more particularly each trunnions 47*a*) is preferably eccentrically engaged within the rotatable mounting assembly 53, which can be selectively rotated within the frame 18 by a suitable mechanism such that the plate cylinder is disconnected from contacting engagement with the blanket cylinder 14. This "throw-off" permits the printing to be interrupted, and subsequently resumed, without having to precisely re-adjust the contact stripe between the two cylinders. When printing is thus interrupted, the impression cylinder 16 can also be "thrown-off" (ie: disconnected from contacting engagement with the blanket cylinder 14) with a suitable mechanism.

The inking unit 20 and dampening unit 22 are displaceable as required to accommodate the particular size of plate cylinder employed, while remaining in contact therewith. Although the plate cylinder 12 is eccentrically mounted, and therefore can be slightly displaced such that it is disengaged from contact with the blanket cylinder 14, the central axis 46 of the plate cylinder 12 otherwise remains secured in place within the frame structure 18. This, therefore, requires that the blanket cylinder 14 is selectively displaceable using the translatable bearing-blocks 63 as described above, such that cylinders of various diameters can be accommodated and a desired contact stripe is maintained between the adjacent cylinders, irrespective of the size of the cylinder (or the outer sleeve thereof) being used.

As shown in FIGS. 5*a* and 5*b*, the relative positions of different sized printing cylinders can be seen. In FIG. 5*a*, a plate cylinder 12*a* and blanket cylinder 14*a* having a first (smallest) diameter are shown. The bearing-blocks 63 of the blanket cylinder are therefore located at the uppermost position within the guide slots 84. In FIG. 5*b*, replacement plate cylinder 12*b* and blanket cylinder 14*b* having a larger diameter have been installed in the press unit in place of the original plate and blanket cylinders 12*a*, 14*a*. The central axis 46 of the plate cylinder is evidently disposed in the same position, while the central axis 48 of the blanket cylinder has been displaced away therefrom, due to the translation of the blanket cylinder bearing-blocks 63 which have been displaced within the guide slots 84 such that the larger diameter plate and blanket cylinders 12*b*,14*b* are repositioned having a predetermined contact stripe therebetween.

As seen in FIGS. 5*a* and 5*b*, the fixed-size impression cylinder 16 is preferably not interchanged regardless of the size of plate and blanket cylinders installed, and remains pivotably engaged within the press. Particularly, the impression cylinder 16 is adjustable on pivoting arms 40 such that the impression cylinder 16 can be correctly positioned with respect to the blanket cylinder 14, irrespective of the size of outer sleeve being employed on the central mandrel shaft 58 thereof. The contact stripe can therefore be maintained therebetween, throughout the range of print repeat sizes possible using the selected sleeve circumferences. The center of rotation 44 of the impression cylinder 16 is thus displaceable, by the pivot arms 40, along the impression cylinder adjustment arc 42. Once the impression cylinder 16 is positioned in the desired location on the displacement arc 42, it can be fixed in position such that the contact stripe between the blanket cylinder 14 and the impression cylinder 16 is maintained, and the impression cylinder 16 can nevertheless rotate about its central rotation axis 44. The impression cylinder 16 is accordingly always the same size, regardless of the chosen circumferences of the plate and blanket cylinders 12,14.

Figure 3B:
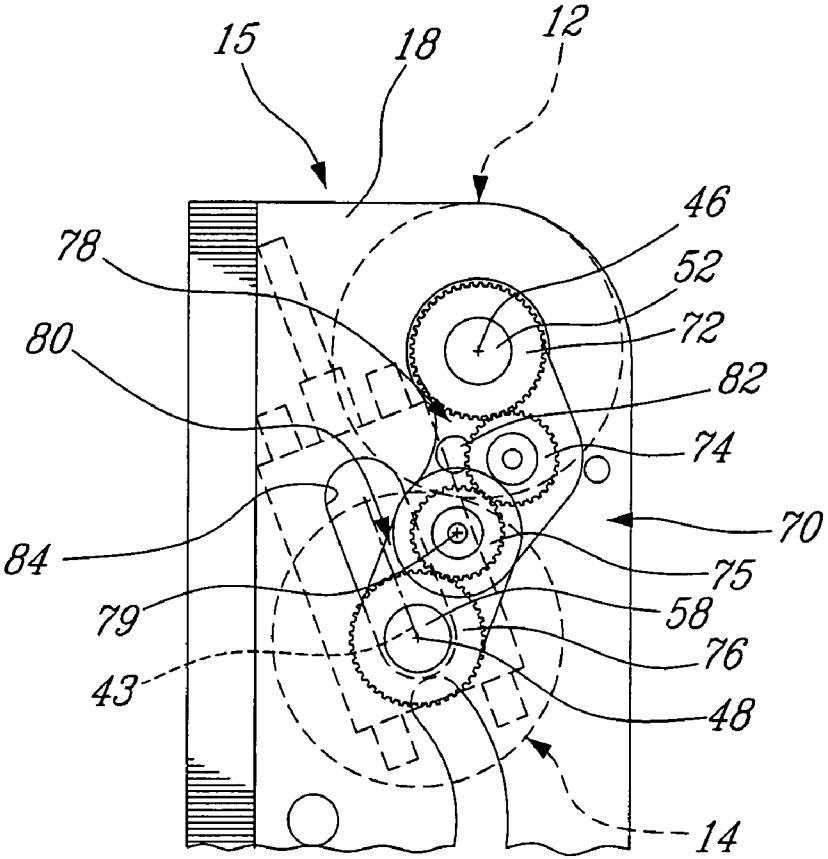
FIG. 3*b* is a schematic side elevation view of the drive linkage mechanism of FIG. 2, showing the plate and blanket cylinders in a second position.
Figure 3A:
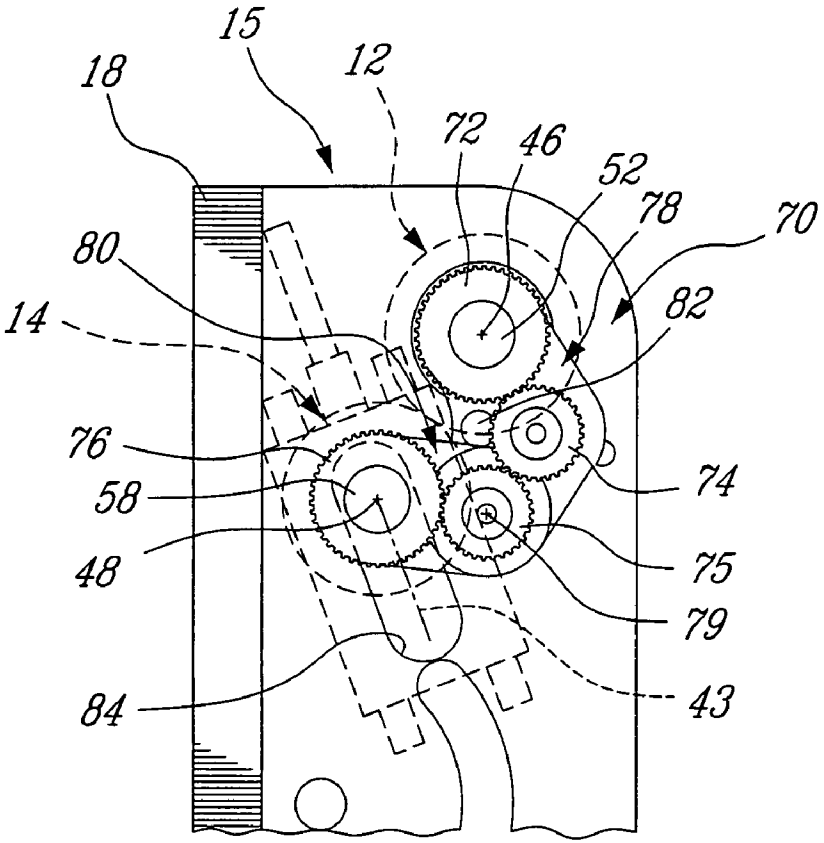
FIG. 3*a* is a schematic side elevation view of the drive linkage mechanism of FIG. 2, showing the plate and blanket cylinders of the present printing press in a first position.
Figure 4:
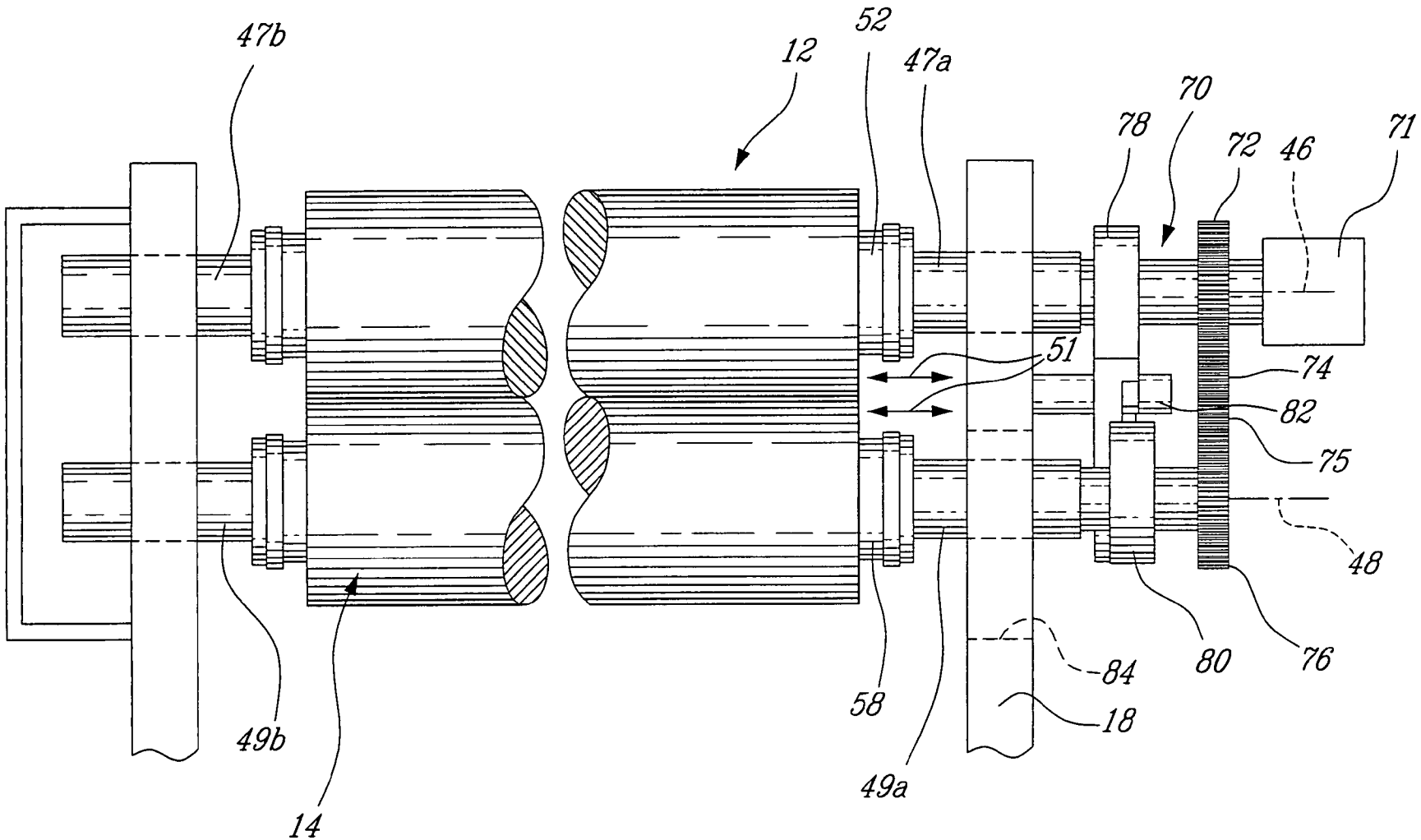
FIG. 4 is a schematic front elevation view of the plate and blanket cylinders and the drive linkage mechanism of FIG. 2.

Referring now to FIGS. 2 to 4, a single drive motor 71, which directly drives the plate cylinder 12 of the printing unit 15, and the plate cylinder 12 is linked with the blanket cylinder 14 by a drive linkage mechanism 70. The drive motor 71 can either be coaxially arranged with the plate cylinder (as shown in FIG. 4) or offset therefrom and interlinked by an idler gear. When the drive motor is said to "directly drive" the plate cylinder herein, it is to be understood that this includes the embodiment in which the plate cylinder gear and the drive motor are offset from each other and linked by an idler gear meshed therebetween. As best seen in FIG. 2, the drive linkage mechanism 70 comprises a blanket cylinder gear 76 and a plate cylinder gear 72, disposed on common ends of each respective cylinder. First and second idler gears 74 and 75, intermeshed with each other and the plate cylinder gear 72 and the blanket cylinder gear 76 respectively, complete the gear train between the two cylinders. The drive linkage mechanism 70 comprises a first linkage arm 78 and a second linkage arm 80, relatively pivotal with respect to each other about a first pivot axis 79, which is preferably coaxial with the shaft of the second idler gear 75 in meshing engagement with the blanket cylinder gear 76. The first linkage arm 78 is also pivotal about the central axis 46 of the plate cylinder 12. The first linkage arm 78 comprises a lateral retaining mechanism 82 which engages the frame structure 18 such that substantial lateral movement of the linkage arms is prevented.

Accordingly, the drive linkage mechanism 70 ensures that the distance between the central axes of the plate cylinder gear 72 and the first idler gear 74 remains constant, as does the distance between the blanket cylinder gear 76 and the second idler gear 75. The two idler gears remain intermeshed regardless of the positions of the first and second linkage arms 78 and 80. Accordingly, the drive linkage mechanism 70 permits the distance between the central axes 46 and 48 of the plate cylinder 12 and the blanket cylinder 14 to be varied, without disengaging the gear train linkage therebetween. This enables the gear mesh through the gear train to be maintained, even as the cylinders are moved relative to each other. The blanket cylinder 14 can accordingly be translated along the blanket cylinder displacement line 43, the translating bearing-blocks 63, within which the trunnions 49*a,b* of the blanket cylinder are mounted, sliding in the correspondingly shaped slot 84 defined in the frame structure 18, without having to disengage to the gear train. This therefore permits sleeves of various diameters to be used, thereby requiring various positions of the cylinders, without having to disengage or reset the mechanical gear linkage between the plate and blanket cylinders. This represents a significant time savings and makes modifying the printing press to vary the repeat length of the printed product much easier. In some prior art systems which permit for interchangeable cylinders or cylinder sleeves, the gear ring for each cylinder must also be changed at the same time as the sleeve thereon. This is not true of the present drive train and linkage mechanism, as the gears remain intermeshed regardless of the position of the cylinders, and the drive motor can be driven at a selected angular speed required to accommodate the chosen sleeve diameters.

The impression cylinder 16 is preferably driven by a smaller transfer gear 64, located at the pivot point 41 of the impression cylinder 16, which can be driven by an independent drive motor or the press main drive.

FIG. 3*a* discloses the drive linkage mechanism 70 of the printing unit 15, wherein the plate cylinder 12 and the blanket cylinder 14 have smallest sized cylinder sleeves thereon. Accordingly, the blanket cylinder 14 is located in an uppermost position within the slot 84. FIG. 3*b* depicts the printing unit, wherein the cylinder sleeves of the plate and blanket cylinders 12,14 have been interchanged for ones having a larger outer diameter. Accordingly, the spacing necessary between the central axes of the two cylinders is much greater, such that the larger diameters of the cylinders can be accommodated. The blanket cylinder is therefore displaced, along the blanket cylinder displacement line 43, to the lower end of the slot 84 in the frame. This is done without having to disengage the gear train linkage between the plate and blanket cylinders. Particularly, by sliding the bearing blocks of the blanket cylinder downward, the second linkage arm 80 is forced to pivot downward about the first pivot axis 79 and the first linkage arm 78 correspondingly moves by slightly pivoting about the central axis 46 of the plate cylinder 12. The idler gears 74 and 75 maintain intermeshed engagement, with each other and the plate and blanket cylinder gears respectively, during the full range of movement. Further, by accurately controlling the movement of the drive linkage mechanism 70, the contact stripe between the plate cylinder 12 and the blanket cylinder 14 can also be precisely selected.

Referring now back to FIG. 4, the trunnions 47*a* and 49*a* of the plate cylinder 12 and the blanket cylinder 14 respectively, are adapted for translation within the frame structure 18 in a direction 51 parallel to, and more particularly coaxially with, the central axes 46 and 48 of the plate and blanket cylinders respectively. In order to permit the complete removal of the plate and blanket cylinders from the press, the trunnions 47*a*,49*a* can be slid outwardly, thereby disengaged the inner ends of the trunnions 47*a,b* and 49*a,b* from the outer ends of the central mandrel shafts 52 and 58 of the plate and blanket cylinders respectively. The trunnions 47*a*,49*a* are only required to outwardly translate by a distance large enough to permit the cylinder to drop out from the inner ends of the trunnions. While the trunnions 47*b*,49*b* are preferably fixed, it is to be understood that these trunnions could also similarly be axially displaced simultaneously with the trunnions 47*a*,49*a* to engage and disengage both ends of the plate and blanket cylinders. The trunnions 47*a*,49*a* of each cylinder can be independently operated, such that each cylinder can be selectively removed when desired. This can be done either remotely, such as by a pneumatically operated mechanism, or manually. The translation of the trunnions does not affect the position of the gear train and drive linkage mechanism 70, which remain substantially laterally fixed in place regardless of whether the trunnions are in the engaged mode, wherein the trunnions and central mandrel shafts are pressed into engagement such that no relative rotation therebetween is possible, or in the disengaged mode, wherein the cylinders can be completely removed from the press. Thus, removal of the cylinders is possible without having to remove or disengage the bearings, within which the cylinder trunnions rotate, from the frame structure 18 of the printing unit 15. Additionally, the sleeves can be easily changed on the central mandrel shafts once they have been removed from the press.

The plate cylinder 12 is also preferably provided with a lateral adjustment mechanism, driven by an independent motor, which allows the press operator to make slight lateral adjustments in the position of the plate cylinder 12 relative to the blanket cylinder 14. This permits fine lateral relative adjustment of the two cylinders to ensure a precise contact stripe therebetween.

The dampening unit 22 and the inking unit 20 are preferably driven by the same drive used for the impression cylinder 16. A servo motor drive, independent of the main motor 71 used to drive the plate cylinder 12, is preferably provided for the impression cylinder 16. However, this impression cylinder servo drive is preferably only used to make small adjustments to the speed of the impression cylinder (ie: to "trim" the speed) and is therefore used for control rather than power. The main drive power for the impression cylinder 16 is preferably provided by the main press gear linkage.

In order to provide the maximum mechanical rigidity of the blanket cylinder 14, and in order to eliminate issues of imprecise impression setting repeatability, an impression "throw off/on" control is further preferably provided. The impression throw-off feature permits the plate cylinder 12 and the impression cylinder 16 to be displaced by a small preset amount, such that they are disengaged from contact with the blanket cylinder 14. This permits printing to be interrupted, without having to drastically displace the cylinders relative to each other, and permits printing to be easily re-started, without having to precisely reset the contact stripes between the cylinders. As described above, the plate cylinder can be "thrown-off" to stop printing by being eccentrically mounted in the rotatable mounting assembly 53. Thus, the rotatable mounting assembly 53 can be rotated within the frame structure 18, such that the plate cylinder is slightly displaced away from the blanket cylinder. The impression cylinder 16 is also disengageable from the blanket cylinder 14 by an adjustment mechanism 86, described in greater detail below.

Particularly referring to FIGS. 5*a* and 5*b*, the impression cylinder adjustment mechanism 86 comprises a first actuator 81, such as a pneumatic cylinder for example, having a first translating end 83 which is pivotably engaged to the impression cylinder pivot arm 40. A second, opposed end 85 of the first actuator 81 is pivotably engaged to an eccentric mounting assembly 87 which is rotatable within the frame structure 18 of the printing unit 15. The eccentric rotating assembly 87 of the first actuator 81 is rotatable by a second actuator 89, preferably a smaller pneumatic cylinder. A first translating end 95 of the second actuator 89 is engaged to the eccentric rotating assembly 87 by a link member 88. Each end of the link member 88 is respectively pivotably connected with the translating end 95 of the second actuator 89 and the second end 85 of the first actuator which is eccentrically engaged to the rotating assembly 87. A second end 97 of the second actuator 89 is not displaceable, but is pivotably fixed to the frame structure 18.

Accordingly, the first actuator 81 is used for impression adjustment, such that the impression cylinder can be displaced to accommodate the particular size of blanket and plate cylinders being employed, and to control the contact pressure between the impression cylinder 16 and the blanket cylinder 14. By extending or retracting the first translating end 83 of the first actuator 81, the impression cylinder pivot arm 44 is thus pivoted such that the impression cylinder 16 displaced as required. The first actuator 81 preferably has a relatively large travel, such that plate and blanket cylinder of various sizes can be accommodated. However, the first actuator is also preferably precisely controlled, such that a desired contact pressure between the impression cylinder 16 and the blanket cylinder 14 can be set. Once this is set, the first actuator 81 is locked, such that the relative positions of the first and second ends thereof are fixed.

The second actuator 89 of the impression cylinder adjustment mechanism 86 is used to "throw-on" or "throw-off" the impression cylinder 16, such that printing can be started or stopped when required. Displacing the translating end 95 of the second actuator 89 acts to rotate the eccentric rotating assembly 87 within the frame structure 18, thereby slightly displacing the second end 85 of the locked first actuator 81 by a slight distance, which accordingly disengages the impression cylinder 16 from contact with web 11 and the blanket cylinder 14 by said slight distance. This slight distance generally corresponds to the eccentricity of the second end 85 of the first actuator 81 relative to the center of rotation of the rotating assembly 87. Thus, the precise location of the impression cylinder and the contact stripe relative to the blanket cylinder can be preset by the first actuator 81 and then locked in position, and the second actuator 89 can be activated to easily engage and disengaged the impression cylinder 16 with the blanket cylinder 14, without having to reset the position and contact stripe each time.

The embodiments of the invention described above are intended to be exemplary. Those skilled in the art will therefore appreciate that the forgoing description is illustrative only, and that various alternatives and modifications can be devised without departing from the spirit of the present invention. Accordingly, the present is intended to embrace all such alternatives, modifications and variances which fall within the scope of the appended claims.

What is claimed is:

1. An offset printing press comprising:

a plate cylinder, a blanket cylinder and an impression cylinder each mounted in a frame structure for rotation about parallel individual axes of rotation, the plate cylinder and the blanket cylinder having a common outer circumference defining a print repeat size produced by the plate and blanket cylinders;

plate and blanket cylinder retention mechanisms respectively engaging the plate cylinder and the blanket cylinder, each retention mechanism comprising first and second trunnions rotatable within the frame structure and respectively engageable to a corresponding cylinder end, at least one of said first and second trunnions being axially displaceable by an actuating member between an operative position and a disengaged position, said at least one trunnion being fastenable in mating engagement with said corresponding cylinder end in the operative position and freely disconnected from said corresponding cylinder end in the disengaged position, such that the plate cylinder and the blanket cylinder are removable from the printing press from between the frame structure; and wherein at least one of the plate and blanket cylinder retention mechanisms is selectively displaceable relative to the frame structure such that a distance between the axes of rotation is variable, said at least one cylinder retention mechanism being fastenable in a desired position to maintain the distance at a predetermined value;

whereby the plate and blanket cylinders are removable from the printing press and substitutable with replacement cylinders having a different outer circumference, thereby providing a correspondingly different sized print repeat when the replacement cylinders are installed into the printing press.

2. The printing press as defined in claim 1, wherein each of the plate and blanket cylinders comprises a central mandrel shaft on which an outer sleeve is removably fixed, the outer sleeves being removable from the central mandrel shafts when the cylinders are removed from the printing press such that substitution of the outer sleeves by replacement sleeves is possible.

3. The printing press as defined in claim 1, wherein the plate cylinder is eccentrically mounted, permitting disengagement of the plate cylinder from contacting engagement with the blanket cylinder to temporarily interrupt printing.

4. The printing press as defined in claim 1, wherein the trunnions are rotatable in the frame structure within bearings, the bearings remaining in contacting engagement with the frame structure when the trunnions are disposed in either one of the operative position and the disengaged position.

5. The printing press as defined in claim 1, wherein the cylinder retention mechanism of the blanket cylinder comprises translating bearing blocks selectively displaceable within corresponding slots in the frame structure such that the blanket cylinder is located in the desired position relative to the substantially fixed plate cylinder.

6. The printing press as defined in claim 1, further comprising a lateral adjustment mechanism providing axial displacement of the plate cylinder relative to the blanket cylinder, thereby permitting fine axial relative adjustment of the plate cylinder and the blanket cylinder to precisely control a contact stripe therebetween.

7. The printing press as defined in claim 6, wherein an independent motor is provided for driving the lateral adjustment mechanism.

8. The printing press as defined in claim 1, wherein the trunnions for each of the plate and blanket cylinders are independently operable, such that each of the plate cylinder and blanket cylinder is independently removable when the corresponding trunnions are displaced to the disengaged position.

9. The printing press as defined in claim 1, wherein the actuating member is pneumatically operated.

10. The printing press as defined in claim 1, further comprising a drive system having a drive motor operatively connected to one of the plate cylinder and the blanket cylinder to provide driven rotation thereto and a gear drive linkage mechanism operably inter-engaging the plate cylinder and the blanket cylinder for mutual rotation thereof, the gear drive linkage mechanism remaining in gear meshed engagement with both the plate cylinder and the blanket cylinder regardless of their variable relative positions.

11. The printing press as defined in claim 10, wherein the drive motor directly drives the plate cylinder.

12. The printing press as defined in claim 11, wherein angular speed of the drive motor is variable, such that the replacement cylinders having the different outer circumference are employable without having to replace gear elements of the drive system.

13. The printing press as defined in claim 1, wherein the plate and blanket cylinder retention mechanisms are independently operable.

* * * * *